US006588383B2

(12) United States Patent
Knaus et al.

(10) Patent No.: US 6,588,383 B2
(45) Date of Patent: Jul. 8, 2003

(54) DIAPHRAGM CARBURETOR FOR AN INTERNAL COMBUSTION ENGINE

(75) Inventors: Konrad Knaus, Gaildorf (DE); Andreas Hägele, Berglen (DE); Werner Geyer, Berglen (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 10/026,098

(22) Filed: Dec. 21, 2001

(65) Prior Publication Data

US 2002/0078909 A1 Jun. 27, 2002

(30) Foreign Application Priority Data

Dec. 22, 2000 (DE) ..... 100 64 519

(51) Int. Cl.[7] ..... F02B 33/04

(52) U.S. Cl. ..... 123/73 CB; 123/DIG. 5; 261/35

(58) Field of Search ..... 123/73 CB, 73 C, 123/73 AD, 73 A, DIG. 5, 198 C; 261/35, 36.2, 64.1, 69.2, DIG. 68, DIG. 83

(56) References Cited

U.S. PATENT DOCUMENTS 4,168,288 A * 9/1979 Nau et al. ..... 261/35
4,168,687 A * 9/1979 Kurahashi et al. ..... 123/510
5,843,345 A * 12/1998 Guntly ..... 261/34.2
6,446,611 B2 * 9/2002 Ishikawa ..... 123/509

FOREIGN PATENT DOCUMENTS

DE 22 55 594 5/1974
GB 1410374 A * 10/1975 ..... F02M/5/10

* cited by examiner

*Primary Examiner*—Henry C. Yuen
*Assistant Examiner*—Hyder Ali
(74) *Attorney, Agent, or Firm*—R W Becker & Associates; R W Becker

(57) ABSTRACT

A diaphragm carburetor for an internal combustion engine is provided, and has a housing with an impulse pressure driven fuel pump. Provided in the housing is a chamber that is divided by a diaphragm into a pump chamber and a drive chamber that is acted upon by impulse pressure fluctuations during operation of the internal combustion engine. In order with the least available impulse pressure differences of the engine to effectively deflect the diaphragm in the chamber, the freely movable diaphragm surface of the diaphragm is maximized and the conveying stroke of the diaphragm is enhanced by a spring. The movable diaphragm surface assumes a major portion of the surface of the plane of separation in which the diaphragm is disposed. For this purpose, a fuel intake valve and a fuel outlet valve are spaced from the diaphragm, and in particular are removed from the plane of separation in which the diaphragm comes to rest.

19 Claims, 4 Drawing Sheets

DIAPHRAGM CARBURETOR FOR AN INTERNAL COMBUSTION ENGINE

BACKGROUND OF THE INVENTION

The present invention relates to a diaphragm carburetor for an internal combustion engine.

DE 22 55 594 discloses a diaphragm carburetor for an internal combustion engine, according to which an impulse pressure driven fuel pump is disposed in the carburetor housing. The fuel pump is embodied as a diaphragm pump, the diaphragm of which separates a fuel conveying chamber or a pump chamber and an impulse chamber or an operating chamber. The impulse chamber is connected to a source of pulsating pressure, and the diaphragm is acted upon by a spring that extends through the impulse chamber. At partial vacuum impulses, the diaphragm moves against the force of the spring, which during a change to pressure impulses enhances the fuel conveyance in the pump chamber and reinforces the fuel conveying pressure of the diaphragm pump. With this known diaphragm carburetor, it is not possible to have a disruption-free operation, especially in conjunction with an internal combustion engine having only weak positive pressure impulses.

It is therefore an object of the present invention to provide a diaphragm carburetor of the aforementioned general type with which it is possible to have a disruption-free operation of the internal combustion engine even with predominantly negative pressure impulses of the engine.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
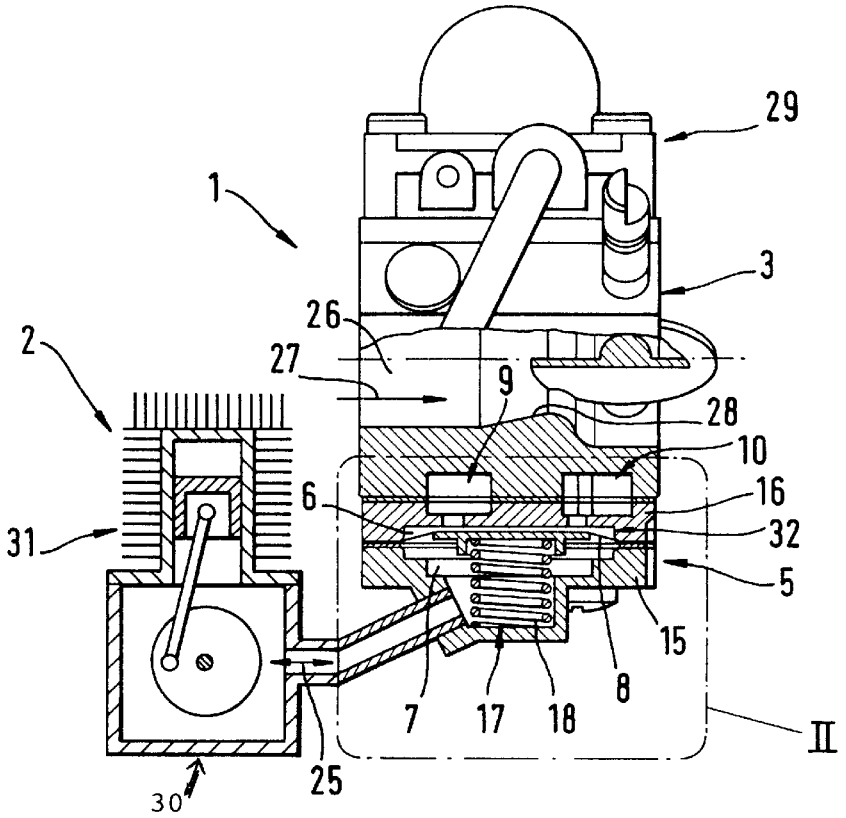
FIG. 1 is a side view of one exemplary embodiment of a diaphragm carburetor, with a longitudinal cross-section of a fuel pump.

The diaphragm carburetor of the present invention comprises an impulse pressure driven fuel pump that is disposed in a carburetor housing and is formed of a pump chamber, an operating chamber, and a diaphragm to which force is applied by a spring; lateral edges of the diaphragm are held in a plane of separation between sections of the housing, wherein the diaphragm separates the pump chamber and the operating chamber; a freely movable diaphragm surface is defined between the lateral edges of the diaphragm, which are spaced apart by a distance that in the plane of separation is equal to more than half of the width of the carburetor housing; a fuel intake valve and a fuel outlet valve are associated with the pump chamber and are disposed at a distance from the plane of separation.

In order with the impulse pressure driven fuel pump to be able to effect a reliable fuel conveyance even at predominantly or exclusively negative pressure impulses in the drive chamber of the fuel pump, the movable diaphragm surface of the pump diaphragm is maximized. The surface portion, in other words the movable diaphragm surface, that is present between the diaphragm edges that are clamped in the carburetor housing is in particular maximized by having all possible functional elements, especially a fuel intake valve and a fuel outtake valve, be removed out of the plane of separation of the carburetor housing in which the diaphragm is disposed and by having them be disposed at a distance to the plane of separation in which the diaphragm is disposed.

If a partial pressure impulse acts upon the diaphragm in the drive chamber, due to the large diaphragm surface an adequate return force that acts against the force of the spring is effected against the diaphragm. The displacement path of the diaphragm is a function of the magnitude of the partial pressure, i.e. as the partial pressure increases the spring is tensioned further. The axial extent of the pump chamber and working chamber make it possible for the fuel pump to operate in different operating ranges, i.e. with pressure pulses at a higher or lower pressure level.

The feature of disposing the fuel intake valve and fuel outlet valve at a distance from a wall of the pump chamber in a separate functional plane of the diaphragm carburetor leads to a simplification of the construction of the carburetor. The plane of separation of the carburetor housing in which the diaphragm comes to rest is preferably approximately the same size as a base surface of the carburetor. The drive chamber is expediently formed in a housing cover of the carburetor. Provided on this housing cover is an impulse connector for the supply of the pressure and partial vacuum impulses. It is expedient to form the pump chamber in a separate component that is connected to the main body of the diaphragm carburetor. In the installed state of the diaphragm carburetor, the component is disposed as an intermediate piece between the housing cover of the carburetor and the main body of the carburetor. The volume of the pump chamber can thus be dimensioned as a function of the height of the intermediate piece. The spring serves for the return of the diaphragm when a weakening partial pressure impulse, or a positive pressure impulse, is encountered. The change in position of the diaphragm caused thereby thus effects the fuel conveyance. A helical spring, especially a compression spring is preferably utilized. The compression spring is preferably disposed in the drive chamber, and in turn is supported against the inner wall of the housing cover as well as against the diaphragm. Alternatively, it is also possible to embody the spring as a tension spring or a leaf spring and to dispose it in the pump chamber. A diaphragm plate that comes to rest in a planar manner against the diaphragm is preferably disposed against the spring and the diaphragm. The diaphragm plate can be secured not only against the diaphragm itself but also against the spring. The diaphragm plate preferably partially surrounds one end of the helical spring on that side that faces away from the diaphragm. The spring is thereby stabilized in its position transverse to its longitudinal axis, and is held in an elastic manner.

The fuel intake valve and the fuel outlet valve are preferably disposed in the interface between the intermediate piece and the main body of the carburetor. In this way, the valves are easy to embody as diaphragm check valves having a large open valve cross-section.

The impulse connector at the drive chamber is to be in fluid communication with a source of pulsating pressure of the internal combustion engine. The internal combustion engine can be not only a two-stroke engine but also a four-stroke internal combustion engine, in particular a mixture lubricated four-stroke internal combustion engine. In order to tap the pulsating pressure, the crankcase or an intake conduit for combustion air is suitable as the source on the internal combustion engine. With a four-stroke internal combustion engine, in particular a mixture lubricated internal combustion engine, it is expedient to provide as the source of pulsating pressure the valve housing, the valve drive housing, the crankcase, or an intake conduit for the combustion air. In particular with four-stroke internal combustion engines, the pulsating pressure is in the range of the external pressure of the internal combustion engine or of the negative pressure. If an easy to flex elastomeric flat diaphragm is used as the diaphragm of the fuel pump, this facilitates the deflection of the diaphragm. The diaphragm itself is in this connection advantageously supported by the diaphragm plate.

In order to compensate for fluctuations of the impulse pressure, and thereby resulting fluctuations of the fuel conveying pressure, it is provided that the volume of the pump chamber be of such a magnitude that the pump chamber serves as an intermediate storage for fuel that is under pressure.

Further specific features of the present invention will be described in detail subsequently.

DESCRIPTION OF PREFERRED EMBODIMENTS

Referring now to the drawings in detail, the diaphragm carburetor 1 illustrated in FIG. 1 serves for the preparation of a mixture, such as a fuel/air mixture, for an internal combustion engine 2, especially for a two-stroke engine or a four-stroke engine. Such an engine is advantageously usable in manually-guided implements such as power chain saws, brushcutters, trimmers, cut-off machines, lawn mowers, or the like.

Formed in the diaphragm carburetor 1 is an intake channel 26 via which combustion air 27 flows in the direction of the arrow to the intake port of the internal combustion engine. Formed in the intake channel 26 is a venturi section 28, in the region of which open fuel nozzles. The nozzles are supplied from a control chamber 29 (see FIGS. 1 and 3) in the interior of the carburetor housing 3. If combustion air flows through the intake channel 26, fuel exits the nozzles and is mixed together with the combustion air. The control chamber 29 is supplied with fuel from a fuel pump 5 via a feed channel. In the illustrated embodiment, the fuel pump 5 is driven by the fluctuating pressure 25 in the crankcase 30 of a four-stroke engine 31. For this purpose, a chamber 32 of the fuel pump 5 between the housing sections 15, 16 of the carburetor housing 3 is divided into a pump chamber 6 and a drive chamber 7. These two chambers 6, 7 are separated from one another by a diaphragm 8.

The drive chamber 7 is in fluid communication with the crankcase 30 of the four-stroke engine 32, as a result of which pressure fluctuations are introduced into the drive chamber 7. Alternatingly present at the diaphragm 8 is, for example, a partial vacuum or approximately ambient atmospheric pressure, whereby the pressure fluctuations are a function of the speed, of the type of internal combustion engine, and of the source 22 (see FIG. 2) of the pulsating pressure 25 (crankcase, valve housing, valve drive housing, and intake tube). The pump movements of the diaphragm 8 caused thereby effect a fuel feed as a consequence of volume alteration of the pump chamber 6 and by means of a fuel intake valve 9 and a fuel outlet valve 10. The valves are preferably embodied as diaphragm check valves, ball valves or the like.

The pump chamber 6 is supplied with fuel via the fuel intake valve 9, so that during the intake fuel flows continuously into the pump chamber. During a subsequent conveying stroke of the diaphragm 8 in the direction of the main body 4 of the carburetor, the fuel intake valve closes and the fuel outlet valve opens, so that the fuel is conveyed with pressure through the feed channel into the control chamber and passes with a defined pressure into the intake channel 26.

Figure 2:
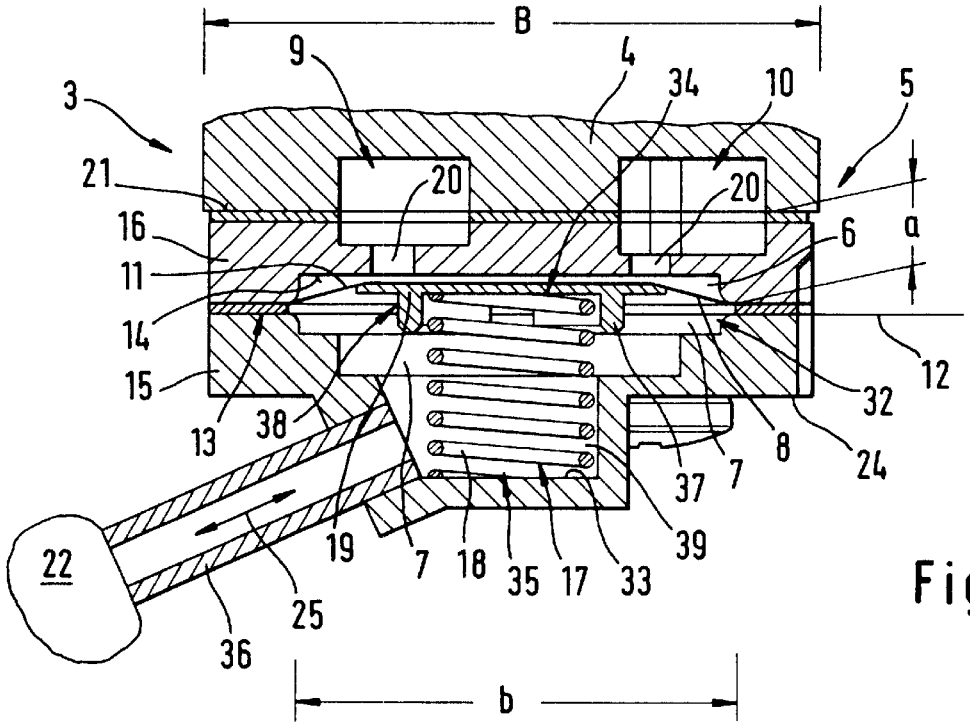
FIG. 2 shows the portion 11 of FIG. 1.
Figure 3:
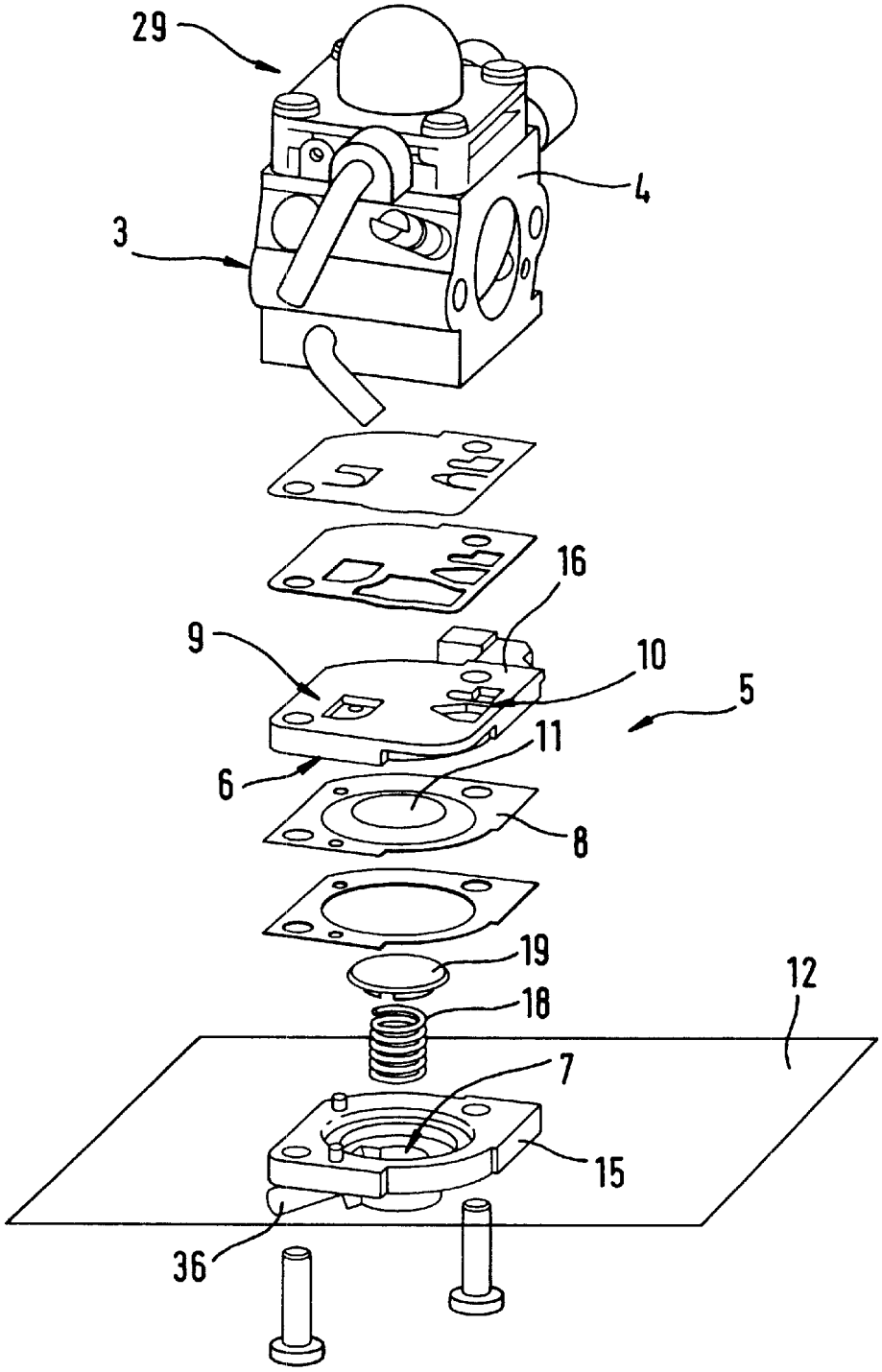
FIG. 3 is an exploded view of the diaphragm carburetor of FIG. 1.

As shown in particular in FIG. 2, which is a partial section 11 from FIG. 1, and in FIG. 3, the diaphragm 8 is embodied as an elastomeric flat diaphragm. Provided approximately in the center of the diaphragm 8 is a circular disk-shaped movable diaphragm surface or section 11. The diaphragm section 11 forms a portion of the surface 13 of the plane of separation 12 in which the diaphragm 8 comes to rest in the carburetor housing 3. The surface of the plane of separation 12 is approximately the same size as a base surface 24 of the carburetor. The diaphragm 8 is held between the carburetor housing cover 15 and the intermediate piece 16. Between the clamped or held edges of the diaphragm 8, the movable diaphragm section 11 has a span b that corresponds in large part to the width B of the carburetor housing 3. In this way there results a relatively large force-engageable surface 11 of the diaphragm 8.

The drive chamber 7 of the fuel pump 5 is formed in the carburetor housing cover 15, while a recess having a nearly rectangular cross-sectional configuration in the intermediate piece 16 forms the pump chamber 6. A spring 17, which in the illustrated embodiment is embodied as a helical spring 18, is disposed in a spring-clamped manner between the base 33 of the carburetor housing cover 15 and the diaphragm 8. A flat diaphragm plate 18 is disposed at one end 34 of the helical spring 18 between the diaphragm 8 and the spring 18. The diameter of the diaphragm plate 19 is approximately twice as great as the diameter of the helical spring 18. The backside of the diaphragm plate 19, which faces the helical spring 18, has a sleeve-like configuration, whereby the wall 37 of the sleeve 38 radially surrounds the end 34 of the helical spring 18.

The other end 35 of the helical spring 18 is radially held in a recess 39 of the carburetor housing cover 15. In this way, the helical spring 18 is movably radially held and guided in the drive chamber 7. Instead of using a helical compression spring, it can be expedient to provide a tension spring in the pump chamber. The tension spring can also be embodied as a leaf spring, a plate spring, or a spring blade. It is expedient to connect the diaphragm plate 19 with the diaphragm 8 in a positive or frictional manner, for example by rivets.

The diaphragm section 11, which is freely movable in the chamber 32, should be as large as possible in order, with the low pressure differences that are available especially with four-stroke engines, or also with the low-pressure differences that are available with a two-stoke engine, to produce a sufficiently large force during idling for the return and biasing of the spring in the drive chamber. For this reason, in the illustrated embodiment the fuel intake valve 9 and the fuel outlet valve 10 are disposed at a distance a from the functional plane of the diaphragm 8.

The fuel intake valve 9 and the fuel outlet valve 10 are disposed at the distance a relative to the plane of separation 12 approximately in an interface 21 between the intermediate piece 16 and the main body 4 of the carburetor. As shown in FIG. 2, for the fluid communication of the pump chamber 6 with the fuel intake valve 9 and the fuel outlet valve 10, two orifices 20 are provided in the intermediate piece 16. Thus, in connection with the available space, the valves can be disposed at any desired distance from the inner wall 14 of the pump chamber 6. The pump chamber 6 can be expanded in a desired manner to form a temporary storage chamber for fuel. As a consequence of these structural features, it is possible to have a compensation of the impulse pressure fluctuations that occur during operation of an internal combustion engine. Fluctuations of the fuel conveying pressure and of the fuel conveying quantity are thereby effectively compensated for. In particular, when starting or restarting the internal combustion engine, it is thereby possible to make use of the fuel volume that is already under pressure in the pump chamber 6. A satisfactory mixture formation is thereby effected in the intake channel 26 of the carburetor 1.

Figure 4:
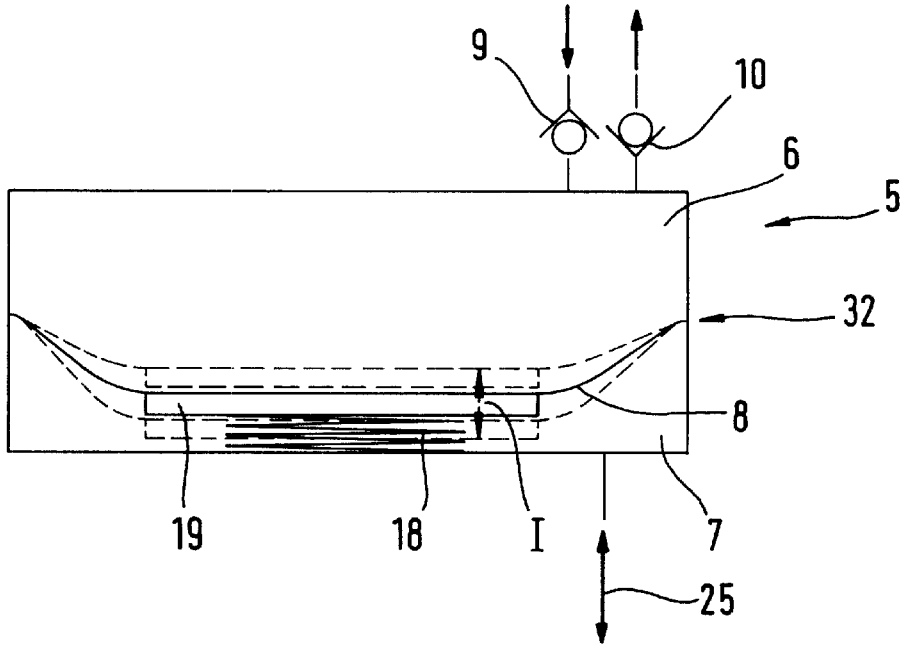
FIG. 4 is a schematic cross-sectional view through the fuel pump with a partial vacuum impulse applied in the pump chamber in a first operating range.

During operation of the fuel pump, pulsating pressure from the source 22 is supplied via a connector that is disposed essentially radially in the carburetor housing cover 15 so as to supply the drive or operating chamber 7 with a partial vacuum that acts on the diaphragm 8. Under the effect of the partial vacuum, the diaphragm 8 moves against the spring force of the helical spring 18 with its diaphragm plate 19 in a direction toward the base 33 of the carburetor housing cover 15. By way of example, FIG. 4 shows that at a certain partial vacuum, for example in the order of magnitude of about 0.5 bar, the diaphragm 8 is considerably deflected against the spring 18. The solid line shows a central position of a first operating range I, and the dashed lines show the deflections as a consequence of the pressure pulsations, whereby the pressure amplitude between the deflections is, for example, 0.1 bar. The diaphragm stroke generated thereby can be approximately 0.25 mm.

Figure 5:
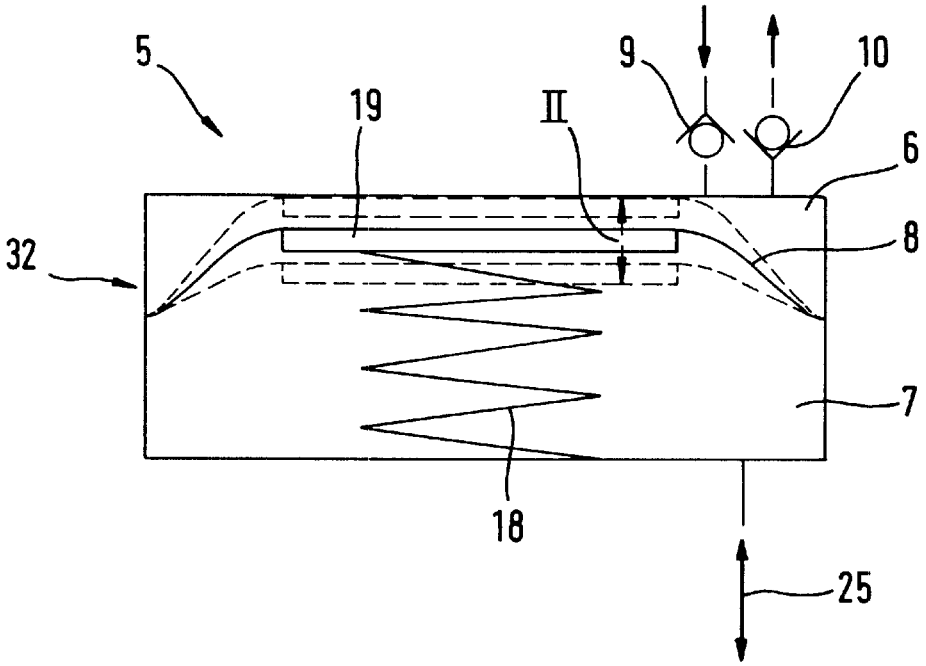
FIG. 5 is a schematic cross-sectional view through the fuel pump in a second operating range.

FIG. 5 shows that in the region of a different pressure level a second operating range II is established. From the base position of the diaphragm 8 illustrated by the solid line, with the spring 18 relaxed, at a partial pressure pulse in the drive chamber of about 0.15 bar the diaphragm 8 is deflected against the spring force. This corresponds to the lower dashed-line position in FIG. 5. With an attenuation of the pressure pulse there is effected an opposite movement of the diaphragm 8 due to the return force of the spring 18 and due to positive pressure pulses, i.e. increasing over the relative normal pressure of 0 bar, there is effected in the drive chamber 7 a deflection of the diaphragm into the upper dashed-line position in FIG. 5.

It is to be understood that between the operating ranges I and II illustrated in FIGS. 4 and 5 any desired intermediate ranges could also be established, or are automatically established due to the respective actual pressure level.

A flat diaphragm that is easy to flex is preferably utilized, as a result of which only slight deformation force has to be applied for the diaphragm itself, and even at the least available pressure impulse fluctuations, a maximum fuel conveying capacity of the fuel pump 5 is effected.

Figure 6:
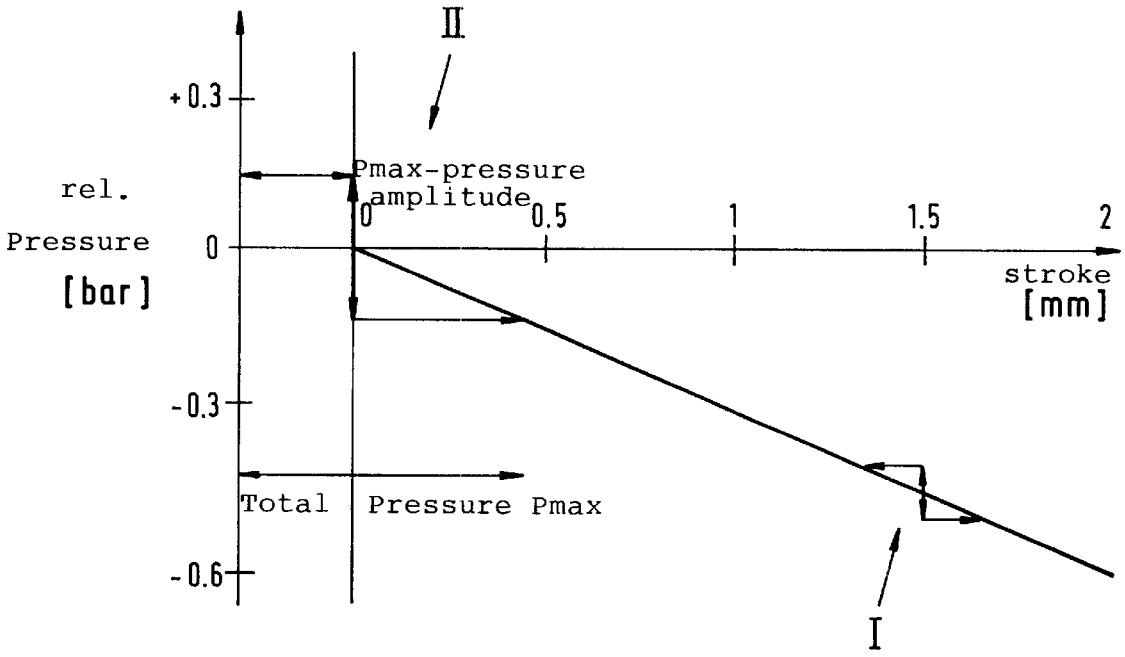
FIG. 6 shows the stroke of a fuel pump diaphragm plotted against the relative pressure in the pump chamber.

FIG. 6 is a graph in which the stroke movements of the diaphragm are plotted against the impulse pressure fluctuations generated by an internal combustion engine, for example in the operating ranges I and II. From this graph it can be seen that the spring characteristic has a proportional path, whereby in the completely relaxed state of the spring 18 the diaphragm 8 is in the normal position at 0 mm stroke. This position is assumed at a relative pressure of 0 bar. In the operating range II, at a negative pressure impulse of, for example, 0.15 bar, a stroke of >0.4 mm is produced against the spring 18. At the end of the negative impulse, the diaphragm 8 is again in the base position, and with a subsequent positive pressure impulse there is effected a stroke, as seen in FIG. 6 to the left, of, for example, 0.3 mm. Thus, an overall stroke of 0.7 mm is utilized.

At a pressure level where the overall amplitude is in the partial vacuum range, as for example in the operating range I, there is respectively utilized the rise of the pressure differential to the normal pressure of 0 bar for the stroke of the diaphragm 8 against the spring 18, whereas upon reduction of this pressure differential the force of the spring acts in the opposite direction and the diaphragm is thus returned somewhat. As can be seen from FIG. 6 in the operating range I, at pressure amplitudes of 0.1 bar pump strokes of about 0.25 mm can still be achieved, so that with the inventive arrangement even such small pressure impulses suffice for a required fuel conveyance.

The specification incorporates by reference the disclosure of German priority document 100 64 519.4 of Dec. 22, 2000.

The present invention is, of course, in no way restricted to the specific disclosure of the specification and drawings, but also encompasses any modifications within the scope of the appended claims.

We claim:

1. A diaphragm carburetor for an internal combustion engine, said carburetor comprising:

a housing having housing sections;

an impulse pressure driven fuel pump that is disposed in said housing and is formed of a pump chamber, an operating chamber, and a diaphragm to which force is applied by a spring, wherein lateral edges of said diaphragm are held in a plane of separation between said housing sections and said diaphragm separates said pump chamber and said operating chamber, and wherein a freely movable diaphragm surface is defined between said lateral edges of said diaphragm, which edges are spaced apart by a distance b that in said plane of separation is equal to more than half of a width B of said housing;

a pressure impulse connector that communicates with said operating chamber;

a fuel intake valve associated with said pump chamber; and a fuel outlet valve associated with said pump chamber wherein both said fuel intake valve and said fuel outlet valve are disposed at a distance a from said plane of separation.

2. A diaphragm carburetor according to claim 1, wherein said fuel intake valve and said fuel outlet valve are disposed at a distance from an inner wall of said pump chamber.

3. A diaphragm carburetor according to claim 1, wherein said carburetor has a base surface, and wherein said plane of separation of said housing is approximately equal in magnitude to said base surface.

4. A diaphragm carburetor according to claim 1, wherein in an orthogonal direction relative to said plane of separation said pump chamber and said operating chamber together have an extent that makes possible a displacement of said diaphragm into different operating ranges as a function of a pressure level.

5. A diaphragm carburetor according to claim 1, wherein said operating chamber is formed in a cover of said housing.

6. A diaphragm carburetor according to claim 5, wherein said pump chamber is disposed in a separate component, known as an intermediate piece, that is connected to a main body of said carburetor.

7. A diaphragm carburetor according to claim 1, wherein said spring is a helical spring that is disposed in said operating chamber.

8. A diaphragm carburetor according to claim 7, wherein said spring is a compression spring.

9. A diaphragm carburetor according to claim 1, wherein said spring is a tension spring and is disposed in said pump chamber.

10. A diaphragm carburetor according to claim 1, wherein a diaphragm plate is disposed between spring and said diaphragm.

11. A diaphragm carburetor according to claim 10, wherein said diaphragm plate is fixedly connected to said diaphragm.

12. A diaphragm carburetor according to claim 10, wherein said diaphragm plate at least partially surrounds said spring.

13. A diaphragm carburetor according to claim 6, wherein said intermediate piece is provided with two orifices for a fluid communication of said pump chamber with said fuel intake valve and said fuel outlet valve, and wherein in an assembled state of said carburetor said intermediate piece, is disposed between said housing cover and said main body of said carburetor.

14. A diaphragm carburetor according to claim 13, wherein at least one of said intake valve and said outlet valve is disposed approximately in an interface between said intermediate piece and said main body of said carburetor.

15. A diaphragm carburetor according to claim 1, wherein said operating chamber is connected to a source of pulsating pressure of a two-stroke internal combustion engine.

16. A diaphragm carburetor according to claim 1, wherein said operating chamber is connected with a source of pulsating pressure of a four-stroke internal combustion engine.

17. A diaphragm carburetor according to claim 1, wherein said diaphragm is an easy to flex diaphragm.

18. A diaphragm carburetor according to claim 17, wherein said diaphragm is an elastomeric flat diaphragm.

19. A diaphragm carburetor according to claim 1, wherein said pump chamber is an intermediate storage for fuel.

* * * * *